US009293845B2

(12) United States Patent
Jeon et al.

(10) Patent No.: US 9,293,845 B2
(45) Date of Patent: Mar. 22, 2016

(54) MEZZANINE RECEPTACLE CONNECTOR

(71) Applicant: Tyco Electronics Corporation, Berwyn, PA (US)

(72) Inventors: James Myoungsoo Jeon, Harrisburg, PA (US); Chad W. Morgan, Carneys Point, NJ (US); Craig Warren Hornung, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 35 days.

(21) Appl. No.: 14/283,575

(22) Filed: May 21, 2014

(65) Prior Publication Data

US 2015/0303600 A1 Oct. 22, 2015

(30) Foreign Application Priority Data

Apr. 22, 2014 (CN) ..... 2014 1 0162611

(51) Int. Cl.

| | |
|---|---|
| ***H01R 12/50*** | (2011.01) |
| ***H01R 12/71*** | (2011.01) |
| ***H01R 12/55*** | (2011.01) |
| ***H01R 12/70*** | (2011.01) |
| *H01R 13/6587* | (2011.01) |

(52) U.S. Cl.

CPC ..... *H01R 12/714* (2013.01); *H01R 12/55* (2013.01); *H01R 12/7082* (2013.01); *H01R 13/6587* (2013.01)

(58) Field of Classification Search

CPC ..... H01R 23/688
USPC ..... 439/607.05, 65, 607.07, 607.09, 439/607.11, 607.12
See application file for complete search history.

(56) References Cited

U.S. PATENT DOCUMENTS

| | | | | |
|---|---|---|---|---|
| 7,597,581 | B2 | 10/2009 | Trout et al. | |
| 7,837,479 | B1 | 11/2010 | Millard et al. | |
| 7,985,079 | B1 | 7/2011 | Wilson et al. | |
| 8,096,843 | B2 * | 1/2012 | Gong | 439/856 |
| 2005/0196987 | A1 | 9/2005 | Shuey et al. | |
| 2010/0093232 | A1 | 4/2010 | Trout et al. | |
| 2014/0017950 | A1 * | 1/2014 | Peloza | 439/629 |
| 2014/0273671 | A1 * | 9/2014 | Cohen | 439/891 |

FOREIGN PATENT DOCUMENTS

EP 1283565 A2 2/2003

OTHER PUBLICATIONS

International Search Report dated Jun. 29, 2015 for International Application No. PCT/US2015/026289.

* cited by examiner

*Primary Examiner* — Tulsidas C Patel
*Assistant Examiner* — Marcus Harcum

(57) ABSTRACT

A mezzanine receptacle connector includes a housing having a mating end configured to be mated with a mezzanine header connector and a mounting end configured to be mounted to a circuit board. The mating end is opposite the mounting end and includes a plurality of contact cavities configured to receive associated header contacts of the mezzanine header connector. Receptacle contacts are received in corresponding contact cavities of the housing. Each receptacle contact has a main contact and a sub-contact extending from the main contact. The main contact defines a first mating interface and the sub-contact defines a second mating interface. The first and second mating interfaces of each receptacle contact are configured to directly engage the same header contact of the mezzanine header connector at different points of contact.

20 Claims, 6 Drawing Sheets

MEZZANINE RECEPTACLE CONNECTOR

BACKGROUND OF THE INVENTION

The subject matter herein relates generally to mezzanine receptacle connectors.

Known mezzanine connectors mechanically and electrically interconnect a pair of circuit boards in a parallel arrangement. Typically, the mezzanine connector will engage both circuit boards to interconnect the circuit boards. For example, the mezzanine connector will be mounted to one of the circuit boards and will engage the other circuit board at a separable mating interface. The mezzanine connector typically uses deflectable spring beams at the separable mating interface. However, such interfaces require a significant amount of real estate and space because the spring beams require long beam lengths to achieve the required spring force. Contact density of such mezzanine connectors is limited because of the separable mating interface and deformation range. At least some known mezzanine connector systems utilize two mezzanine connectors, each mounted to a different circuit board and then mated together. Such systems can be complex and difficult to manufacture. For example, such mezzanine connectors have many contacts individually loaded into a housing, which may be difficult and time consuming to assemble. Furthermore, known mezzanine connectors suffer from signal performance limits due to the tight spacing of the contacts in the mezzanine connectors.

Thus, a need exists for a mezzanine connector assembly that provides a cost effective and reliable connection between circuit boards.

BRIEF DESCRIPTION OF THE INVENTION

In one embodiment, a mezzanine receptacle connector is provided including a housing having a mating end configured to be mated with a mezzanine header connector and a mounting end configured to be mounted to a circuit board. The mating end is opposite the mounting end and includes a plurality of contact cavities configured to receive associated header contacts of the mezzanine header connector. Receptacle contacts are received in corresponding contact cavities of the housing. Each receptacle contact has a main contact and a sub-contact extending from the main contact. The main contact defines a first mating interface and the sub-contact defines a second mating interface. The first and second mating interfaces of each receptacle contact are configured to directly engage the same header contact of the mezzanine header connector at different points of contact.

In a further embodiment, a mezzanine receptacle connector is provided including a housing having a mating end configured to be mated with a mezzanine header connector and a mounting end configured to be mounted to a circuit board. A receptacle contact is held by the housing. The receptacle contact has a main contact and a sub-contact extending from the main contact. The main contact has a base and extends between a mating end and a terminating end. The terminating end extends from the mounting end of the housing for termination to the circuit board. The mating end has a deflectable spring beam with a first mating interface configured to electrically couple to a corresponding header contact of the mezzanine header connector. The sub-contact extends from the base and has a supporting beam mechanically and electrically connected to the spring beam remote from the base. The sub-contact has a second mating interface configured to electrically couple to a corresponding header contact of the mezzanine header connector remote from the first mating interface.

In another embodiment, a mezzanine connector assembly is provided including a mezzanine header connector and a mezzanine receptacle connector. The mezzanine header connector has a plurality of contact assemblies each having at least one pair of header contacts arranged on opposite sides of a corresponding dielectric holder. The mezzanine receptacle connector is coupled to the mezzanine header connector. The mezzanine receptacle connector has a housing having a plurality of contact cavities. Each contact cavity receives an associated dielectric holder and pair of header contacts of the mezzanine header connector. The mezzanine receptacle connector has receptacle contacts arranged in pairs and received in corresponding contact cavities of the housing. Each receptacle contact has a main contact and a sub-contact extending from the main contact. The main contact has a first mating interface and the sub-contact has a second mating interface. The first and second mating interfaces of each receptacle contact directly engage the same header contact of the mezzanine header connector at different points of contact.

DETAILED DESCRIPTION OF THE INVENTION

Figure 1:
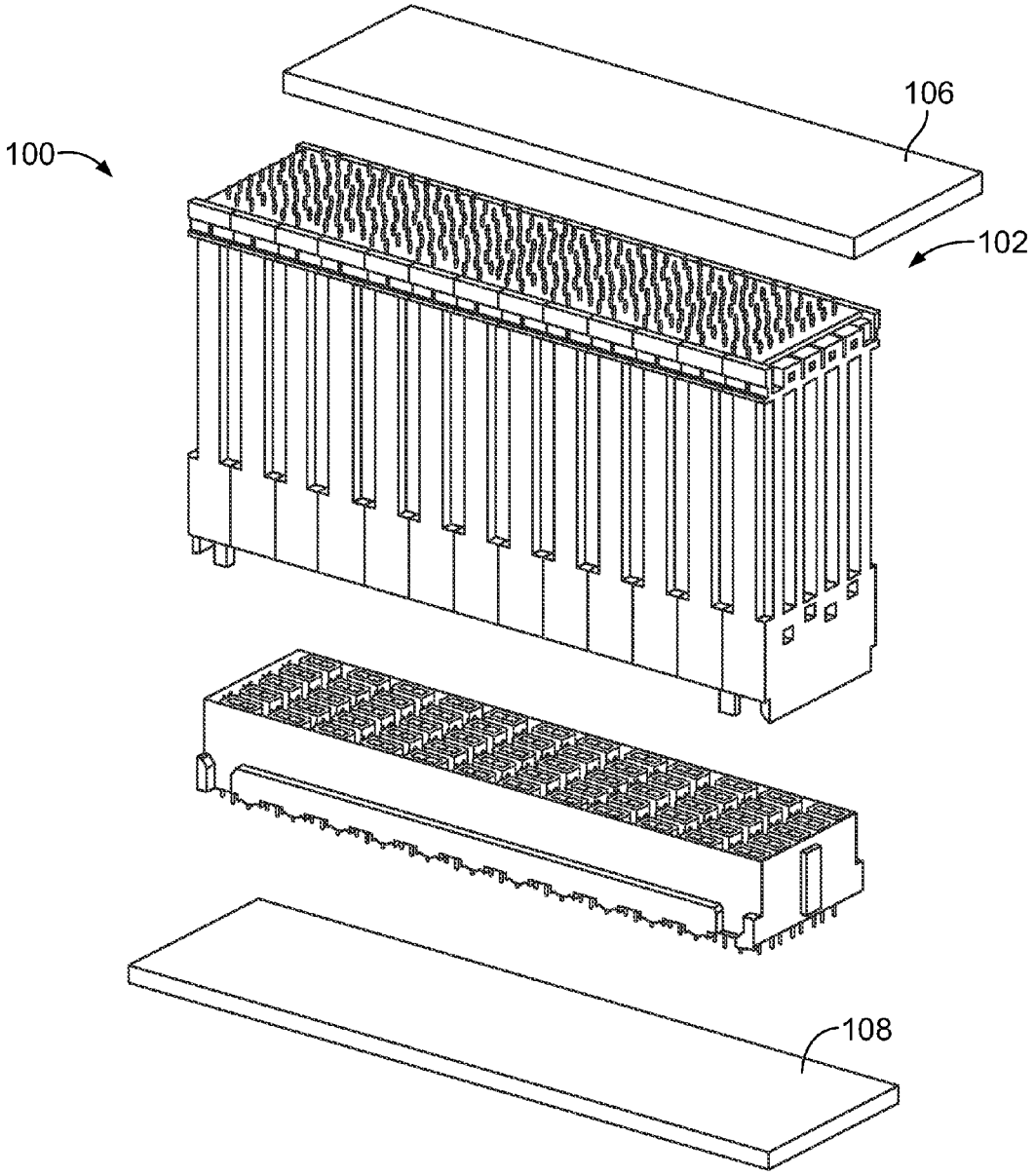
FIG. 1 illustrates a mezzanine connector assembly formed in accordance with an exemplary embodiment.

FIG. 1 illustrates a mezzanine connector assembly 100 formed in accordance with an exemplary embodiment. The mezzanine connector assembly 100 includes a mezzanine header connector 102 and a mezzanine receptacle connector 104 that are mated together to electrically connect first and second circuit boards 106, 108. The mezzanine header connector 102 and mezzanine receptacle connector 104 are arranged to interconnect the first and second circuit boards 106, 108 in a parallel arrangement. However, it is realized that the subject matter herein may be used in other types of electrical connectors as well, such as right angle connectors, cable connectors (being terminated to an end of one of more cables), or other types of electrical connectors.

The circuit boards 106, 108 are interconnected by the header and receptacle connectors 102, 104 so that the circuit boards 106, 108 are substantially parallel to one another. The first and second circuit boards 106, 108 include conductors that communicate data signals and/or electric power between the header and receptacle connectors 102, 104 and one or more electric components (not shown) that are electrically connected to the circuit boards 106, 108. The conductors may be embodied in electric pads or traces deposited on one or more layers of the circuit boards 106, 108, in plated vias, or in other conductive pathways, contacts, and the like.

Figure 2:
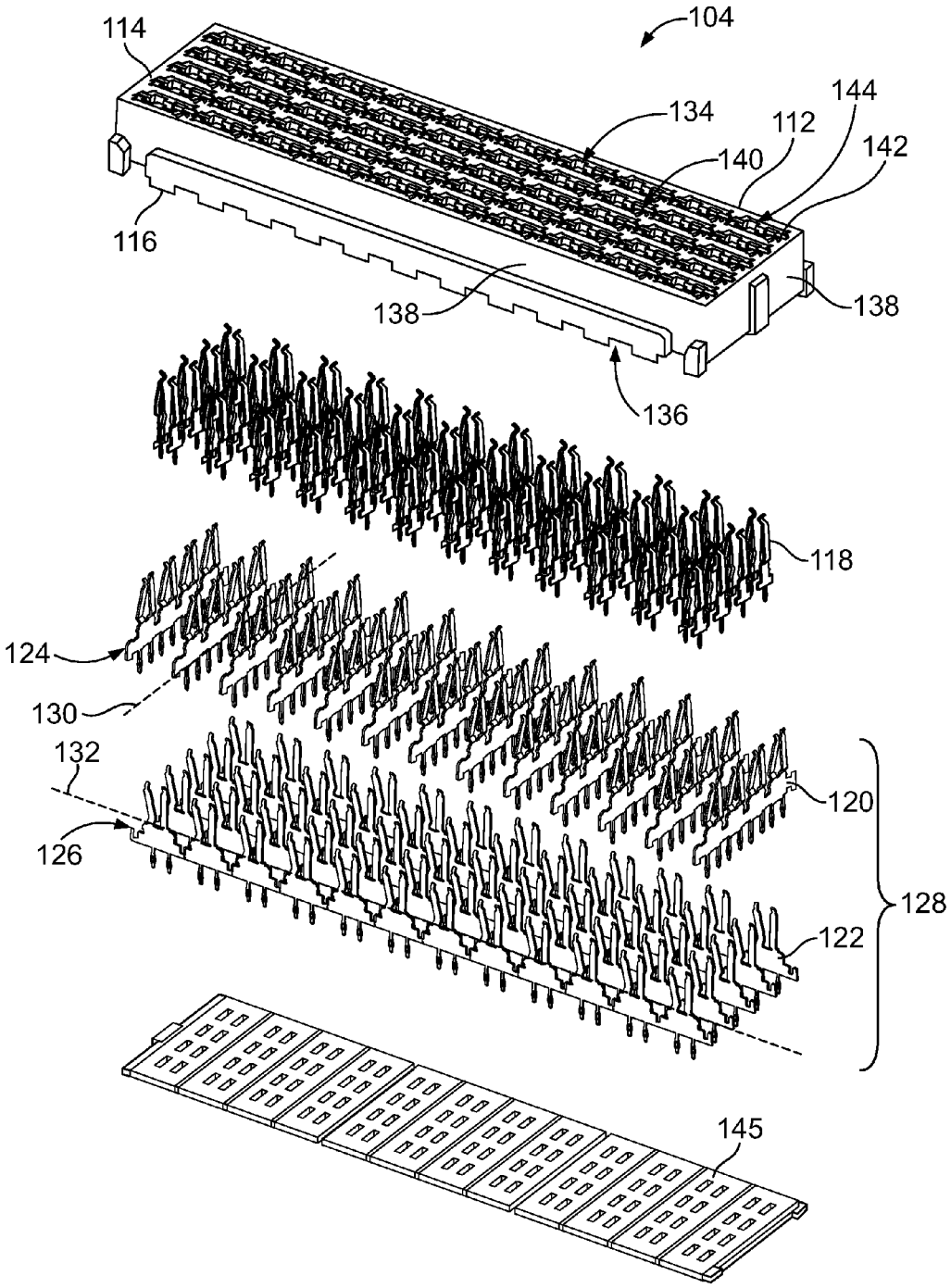
FIG. 2 is an exploded view of a mezzanine receptacle connector of the mezzanine connector assembly in accordance with an exemplary embodiment.

FIG. 2 is an exploded view of the mezzanine receptacle connector 104 in accordance with an exemplary embodiment. The mezzanine receptacle connector 104 includes a housing 112 extending between a front 114 and a rear 116, which may also define a front and a rear, respectively, of the mezzanine receptacle connector 104. The front 114 is configured to be mated with the mezzanine header connector 102 (shown in FIG. 1). The rear 116 is configured to be mounted to the second circuit board 108 (shown in FIG. 1). The housing 112 holds a plurality of receptacle contacts 118 that extend between the front 114 and the rear 116. In an exemplary embodiment, the receptacle contacts 118 are arranged in pairs that carry differential signals. In alternative embodiments, the receptacle contacts 118 may carry single ended signals rather than differential signals. In other alternative embodiments, the receptacle contacts 118 may carry power rather than data signals. The receptacle contacts 118 may be loaded into the housing 112 through the rear 116 of the housing 112.

The mezzanine receptacle connector 104 includes a plurality of lateral receptacle ground shields 120 and a plurality of longitudinal receptacle ground shields 122. In an exemplary embodiment, the lateral receptacle ground shields 120 are configured to be loaded into the housing 112 and extend laterally across the housing 112 parallel to a lateral axis 130 of the housing 112. The longitudinal receptacle ground shields 122 are configured to be loaded into the housing 112 and extend longitudinally across the housing 112 parallel to a longitudinal axis 132 of the housing 112.

The receptacle ground shields 120, 122 may be inserted into the housing 112 through the rear 116 of the housing 112 such that the receptacle ground shields 120, 122 provide electrical shielding for the receptacle contacts 118, such as for each pair of receptacle contacts 118. The receptacle ground shields 120, 122 may be electrically connected to one or more conductive, grounded surfaces of the mezzanine header connector 102 and/or the circuit board 108.

A plurality of the lateral receptacle ground shields 120 are arranged together as part of a common lateral receptacle ground shield strip 124. The lateral receptacle ground shield strip 124 may include any number of the lateral receptacle ground shields 120. A plurality of the longitudinal receptacle ground shields 122 are arranged together as part of a common longitudinal receptacle ground shield strip 126. The longitudinal receptacle ground shield strip 126 may include any number of the longitudinal receptacle ground shields 122. In an exemplary embodiment, the receptacle ground shield strips 124, 126 are interconnected to define a ground lattice 128 to provide shielding around multiple sides of each pair of receptacle contacts 118. For example, each of the lateral receptacle ground shield strips 124 are mechanically and electrically connected to each of the longitudinal receptacle ground shield strip 126. The receptacle ground shield strips 124, 126 may be clipped together or press fit into each other. The lateral receptacle ground shields 120 may provide shielding between rows of receptacle contacts 118 and the longitudinal receptacle ground shields 122 may provide shielding between columns of receptacle contacts 118, as explained in further detail below.

The housing 112 is manufactured from a dielectric material, such as a plastic material. The housing 112 defines a mating end 134 at the front 114 and defines a mounting end 136 at the rear 116, which may be generally opposite the mating end 134. The housing 112 includes sides 138 that define a perimeter of the housing 112 between the mating and mounting ends 134, 136. Optionally, the housing 112 may be generally box shaped, however the housing 112 may have any shape in alternative embodiments.

In an exemplary embodiment, the housing 112 includes receptacle contact openings 140 extending between the mating and mounting ends 134, 136 that receive corresponding receptacle contacts 118. The housing 112 includes lateral receptacle ground shield openings 142 extending between the mating and mounting ends 134, 136 that receive corresponding lateral receptacle ground shields 120, and longitudinal receptacle ground shield openings 144 extending between the mating and mounting ends 134, 136 that receive corresponding longitudinal receptacle ground shields 122.

In an exemplary embodiment, the mezzanine receptacle connector 104 includes a pin organizer 145. The pin organizer 145 is configured to be coupled to the rear 116 of the housing 112. The pin organizer 145 includes a plurality of openings therethrough that receive corresponding pins of the receptacle contacts 118 and/or the receptacle ground shields 120, 122. The pin organizer 145 holds the relative positions of the receptacle contacts 118 and/or receptacle ground shields 120, 122 for mounting to the second circuit board 108 (shown in FIG. 1). The pin organizer 145 may protect the pins of the receptacle contacts 118 and/or the receptacle ground shields 120, 122 from damage, such as during shipping, assembly, and/or mounting to the second circuit board 108.

Figure 3:
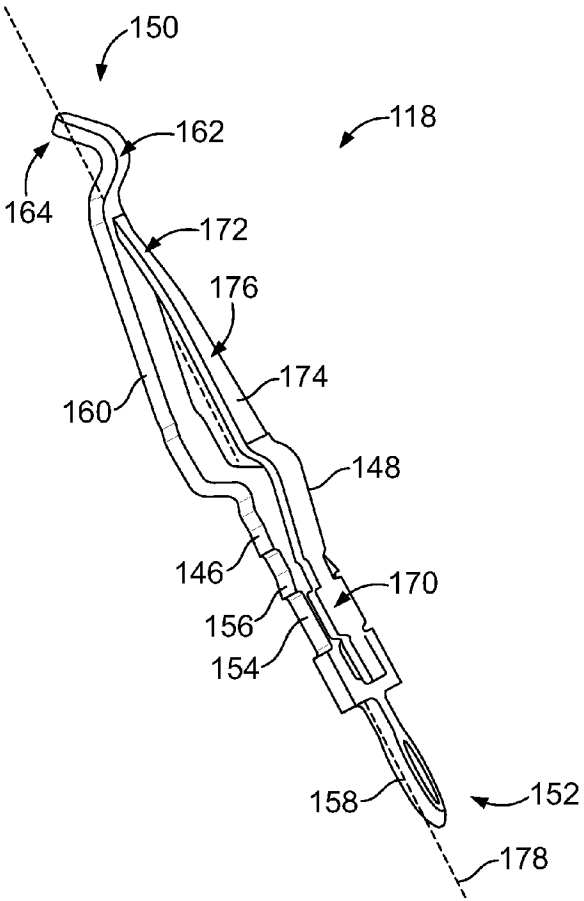
FIG. 3 illustrates a receptacle contact of the mezzanine receptacle connector formed in accordance with an exemplary embodiment.

FIG. 3 illustrates one of the receptacle contacts 118 formed in accordance with an exemplary embodiment. The receptacle contact 118 includes a main contact 146 and a sub-contact 148 extending from the main contact 146. Optionally, the sub-contact 148 may be discrete from the main contact 146 and fixed thereto by a fixing process, such as welding, soldering, crimping, fastening, adhering, and the like. Alternatively, the sub-contact 148 may be integral with the main contact 146, such as both being stamped from a common blank and then formed to position the sub-contact 148 relative to the main contact 146. The main contact 146 and the sub-contact 148 both define points of contact with a corresponding header contact 212 (shown in FIG. 6) of the mezzanine header connector 102 (shown in FIG. 1).

The main contact 146 of the receptacle contact 118 extends between a mating end 150 and a terminating end 152. The main contact 146 of the receptacle contact 118 includes a base 154 between the mating end 150 and the terminating end 152. The base 154 includes barbs 156 along sides thereof for securing the receptacle contact 118 in the housing 112 (shown in FIG. 2).

The receptacle contact 118 includes a compliant pin 158 extending from the base 154 at the terminating end 152. The compliant pin 158 is configured to be terminated to the circuit board 108 (shown in FIG. 1). Types of interfaces other than a compliant pin, such as a solder pin, a solder tail, a spring beam, and the like, may be provided at the terminating end 152 in alternative embodiments.

The receptacle contact 118 includes a spring beam 160 at the mating end 150. The spring beam 160 is deflectable and is configured to be mated with a corresponding contact of the mezzanine header connector 102 (shown in FIG. 1). The spring beam 160 includes a curved mating interface 162 proximate to a distal end 164 of the spring beam 160. The mating interface 162 is configured engage the corresponding header contact 212 (shown in FIG. 6) of the mezzanine header connector 102. The spring beam 160 may be elastically deformed when mated to the header contact 212 and press against the header contact 212 to maintain an electrical connection therewith. Optionally, the distal end 164 may be hook shaped and define a hook, which may be referred to hereinafter as a hook 164.

The sub-contact 148 of the receptacle contact 118 extends between a base end 170 and a support end 172. The base end 170 extends from the base 154. In an exemplary embodiment, the base end 170 is welded to the base 154. Alternatively, the base end 170 may be secured by other methods, such as being soldered, crimped, fastened or otherwise fixed to the base 154. In other alternative embodiments, the support beam 174 may be integral with the base 154, such as being stamped from a common blank.

The sub-contact 148 includes a support beam 174 at the support end 172. The support beam 174 includes a mating interface 176 that is engaged by the header contact 212 (shown in FIG. 6). For example, the support beam 174 of the sub-contact 148 is configured to be directly electrically connected to the header contact 212 to define a second point of contact with the header contact 212 of the mezzanine header connector 102 (shown in FIG. 1).

In an exemplary embodiment, the distal end of the support beam 174 engages the spring beam 160, such as proximate to the mating interface 162. As such, the sub-contact 148 has multiple points of contact with the main contact 146, such as at the base end 170 and the support end 172. The support beam 174 engages the spring beam 160 remote from the base 154. The support beam 174 may support the spring beam 160. The support beam 174 may be deflected with the spring beam 160 when mated with the header contact 212. In an exemplary embodiment, the support beam 174 is a simply supported beam, which is supported at opposite ends by the base 154 and spring beam 160, rather than a cantilevered beam. The support beam 174 is relatively stiff because the support beam 174 is supported at both ends, and thus may be manufactured from a thinner stock of material to reduce the overall cost of the receptacle contact 118. The mating interface 176 may be approximately centered between the base end 170 and the support end 172.

In an exemplary embodiment, the main contact 146 is thicker than the sub-contact 148. For example, the sub-contact 148 is stamped and formed from a stock or blank that is thinner than the stock or blank used to manufacture the main contact 146. The main contact 146 may thus be stiffer than the sub-contact 148.

The receptacle contact 118 extends generally along a contact axis 178. Optionally, the receptacle contact 118 may be oriented such that the contact axis 178 is oriented vertically. The mating interfaces 162, 176 are offset along the contact axis 178. For example, the mating interface 162 of the main contact 146 is positioned vertically above the mating interface 176 of the sub-contact 148. The header contact 212 (shown in FIG. 6) may be mated with the receptacle contact 118 along the contact axis 178 such that the header contact 212 engages the main contact 146 before engaging the sub-contact 148. Optionally, the main contact 146 and the sub-contact 148 may be selectively plated, such as at the mating interfaces 162, 176, respectively. In an exemplary embodiment, the spring beam 160 is bowed or bent outward in a first direction from the base 154, while the support beam 174 is bowed or bent outward in a second direction, generally opposite the first direction, from the base 154.

Figure 4:
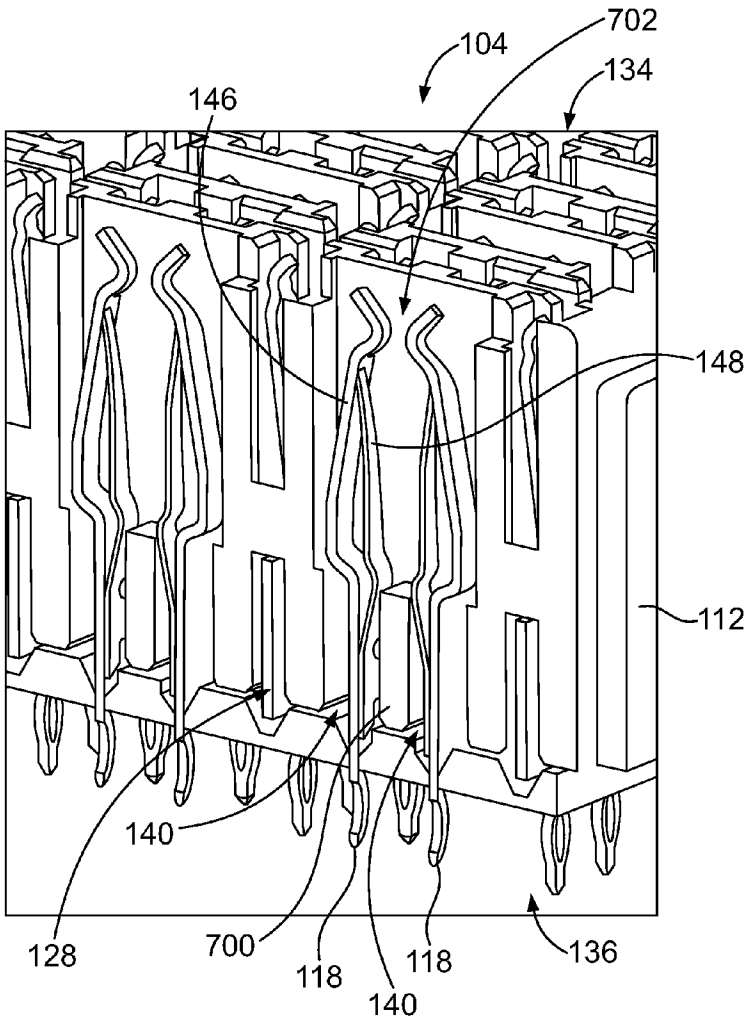
FIG. 4 is a partial sectional view of the mezzanine receptacle connector showing receptacle contacts positioned in a housing.

FIG. 4 is a partial sectional view of the mezzanine receptacle connector 104 showing the receptacle contacts 118 positioned in the housing 112. The receptacle contacts 118 are arranged in pairs and surrounded by the ground lattice 128. The receptacle contacts 118 are positioned in corresponding receptacle contact openings 140 in the housing 112.

At the mounting end 136, the receptacle contact openings 140 are discrete openings or pockets with separating walls 700 defining the receptacle contact openings 140. The receptacle contacts 118 may be held in the receptacle contact openings 140 by an interference fit with the separating walls 700. At the mating end 134, the receptacle contact openings 140 holding pairs of the receptacle contacts 118 are open to each other in a single pocket, which may be referred to hereinafter as a contact cavity 702. Both receptacle contacts 118 of each pair are exposed within the contact cavity 702 for mating with a corresponding pair of the header contacts 212 (shown in FIG. 6). In an exemplary embodiment, both the main contact 146 and the sub-contact 148 are exposed in the contact cavity 702 for mating with the header contact 212.

Figure 5:
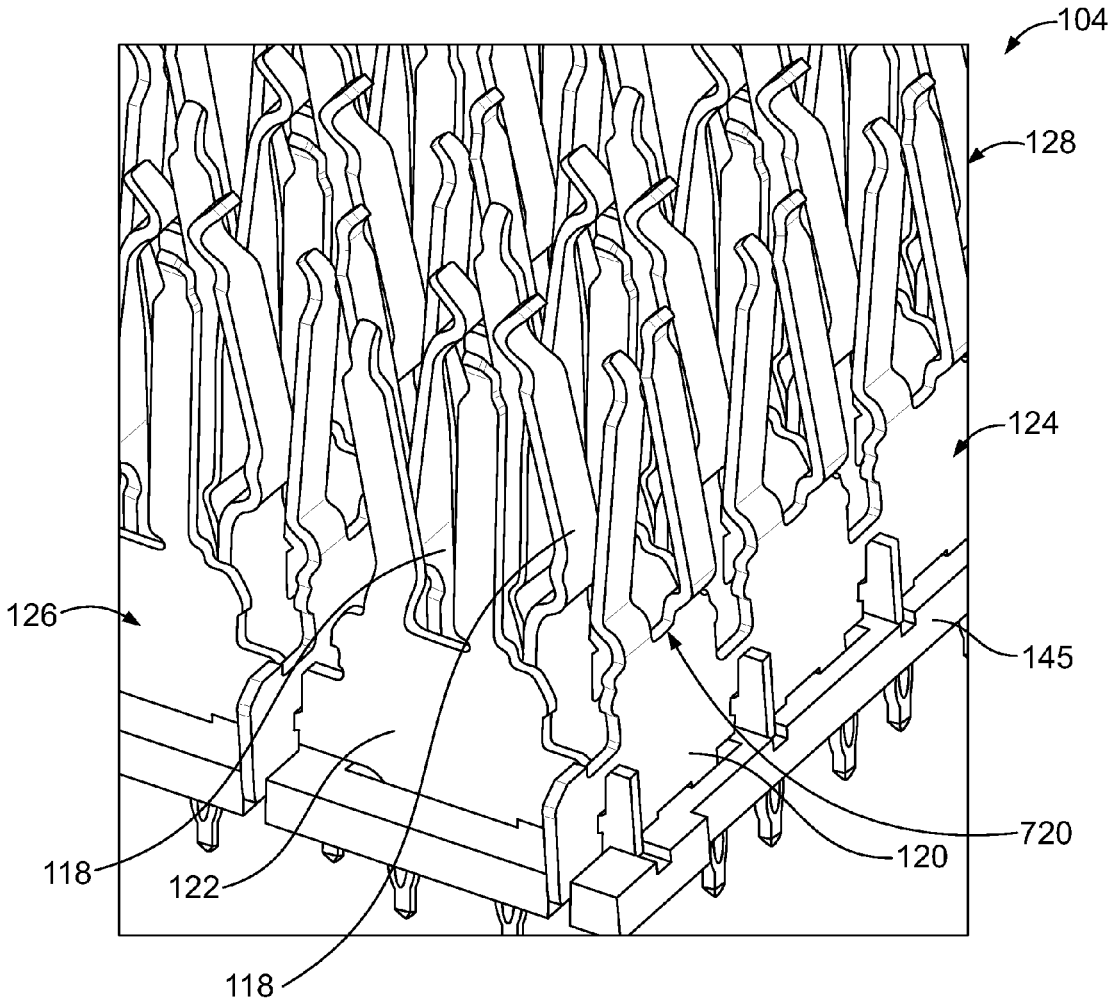
FIG. 5 illustrates a portion of the mezzanine receptacle connector illustrating the receptacle contacts and receptacle ground shields.

FIG. 5 illustrates a portion of the mezzanine receptacle connector 104 with the housing 112 (shown in FIG. 4) removed to illustrate the receptacle contacts 118 and the receptacle ground shields 120, 122 held by the organizer 145. During assembly, the lateral and longitudinal receptacle ground shield strips 124, 126 are loaded into the housing 112 and mated together to form the ground lattice 128, which provides electrical shielding around the receptacle contacts 118. The receptacle ground shields 120, 122 form shield boxes 720 around corresponding pairs of receptacle contacts 118. The shield boxes 720 provide 360° electrical shielding around the perimeter of each pair of receptacle contacts 118.

Figure 6:
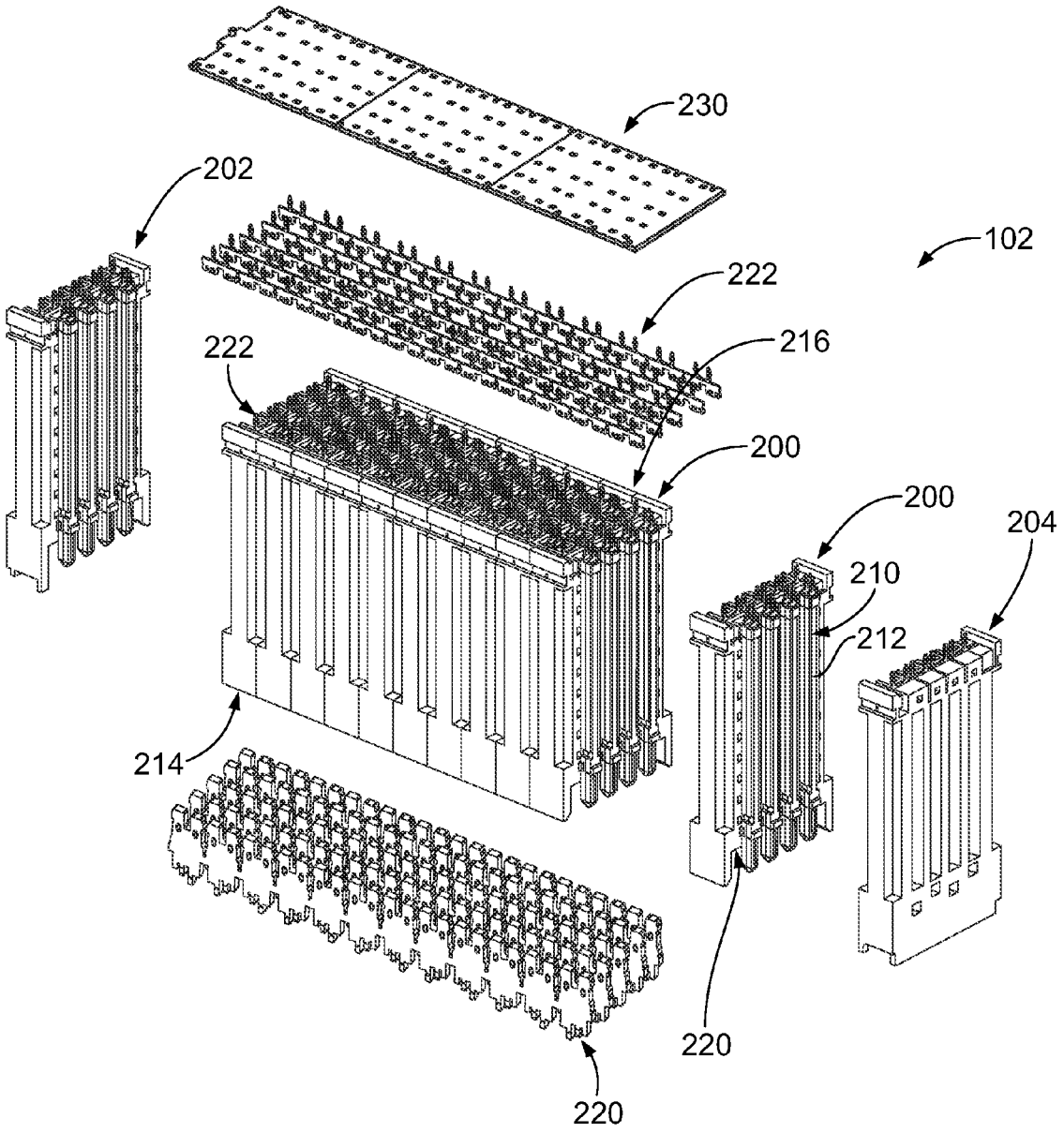
FIG. 6 is an exploded view of a mezzanine header connector of the mezzanine connector assembly in accordance with an exemplary embodiment.

FIG. 6 is an exploded view of the mezzanine header connector 102 in accordance with an exemplary embodiment. The mezzanine header connector 102 includes a plurality of header modules 200, 202, 204. The header modules 200 define middle header modules, which are flanked on opposite sides by the end header modules 202, 204. Any number of middle header modules 200 may be provided depending on the particular application. The end header modules 202, 204 may be identical to one another, or alternatively may be different from one another.

The header modules 200, 202, 204 hold contact assemblies 210, each having a plurality of header contacts 212. The header contacts 212 are configured to be mated with corresponding receptacle contacts 118 (shown in FIG. 2). The header modules 200, 202, 204 are stacked adjacent each other in abutting contact with each other to provide electrical shielding for the header contacts 212. In an exemplary embodiment, the header contacts 212 are arranged in pairs that carry differential signals. The header modules 200, 202, 204 surround the individual pairs of header contacts 212 and provide electrical shielding around each of the pairs of header contacts 212. In alternative embodiments, the header contacts 212 may carry single ended signals rather than differential signals. In other alternative embodiments, the header contacts 212 may carry power rather than data signals.

The header contacts 212 extend between a front 214 of the mezzanine header connector 102 and a rear 216 of the mezzanine header connector 102. The front 214 is configured to be mated with the mezzanine receptacle connector 104 (shown in FIG. 1). The rear 216 is configured to be mounted to the first circuit board 106 (shown in FIG. 1). In an exemplary embodiment, the header modules 200, 202, 204 provide electrical shielding for the header contacts 212 along substantially the entire length of the header contacts 212 between the front 214 and the rear 216.

The mezzanine header connector 102 includes a plurality of front header ground shields 220 at the front 214 and a plurality of rear header ground shields 222 at the rear 216. The header ground shields 220, 222 may be inserted into the header modules 200, 202, 204 such that the header ground shields 220, 222 provide electrical shielding for the header contacts 212. The header ground shields 220, 222 may be electrically connected to one or more conductive surfaces of the header modules 200, 202, 204. The header ground shields 220, 222 are configured to be electrically connected to the mezzanine receptacle connector 104 and the first circuit board 106, respectively.

In an exemplary embodiment, the front header ground shields 220 define a front ground lattice 224 to provide shielding around multiple sides of each pair of header contacts 212. For example, the front header ground shields 220 may include both longitudinal components and lateral components that provide shielding between rows and columns of the header contacts 212. The front header ground shields 220 are configured to be mated with corresponding receptacle ground shields 120, 122 (shown in FIG. 2). The rear header ground shields 222 define a rear ground lattice 226 to provide shielding around multiple sides of each pair of header contacts 212. For example, the rear header ground shields 222 may include both longitudinal components and lateral components that provide shielding between rows and columns of the header contacts 212.

In an exemplary embodiment, the mezzanine header connector 102 includes a pin organizer 230. The pin organizer 230 is configured to be coupled to the rear 216 of the mezzanine header connector 102. The pin organizer 230 includes a plurality of openings therethrough that receive corresponding pins of the header contacts 212 and/or the rear header ground shields 222. The pin organizer 230 holds the relative positions of the header contacts 212 and/or the rear header ground shields 222 for mounting to the first circuit board 106 (shown in FIG. 1). The pin organizer 230 may protect the pins of the header contacts 212 and/or the rear header ground shields 222 from damage, such as during shipping, assembly, and/or mounting to the first circuit board 106.

Figure 7:
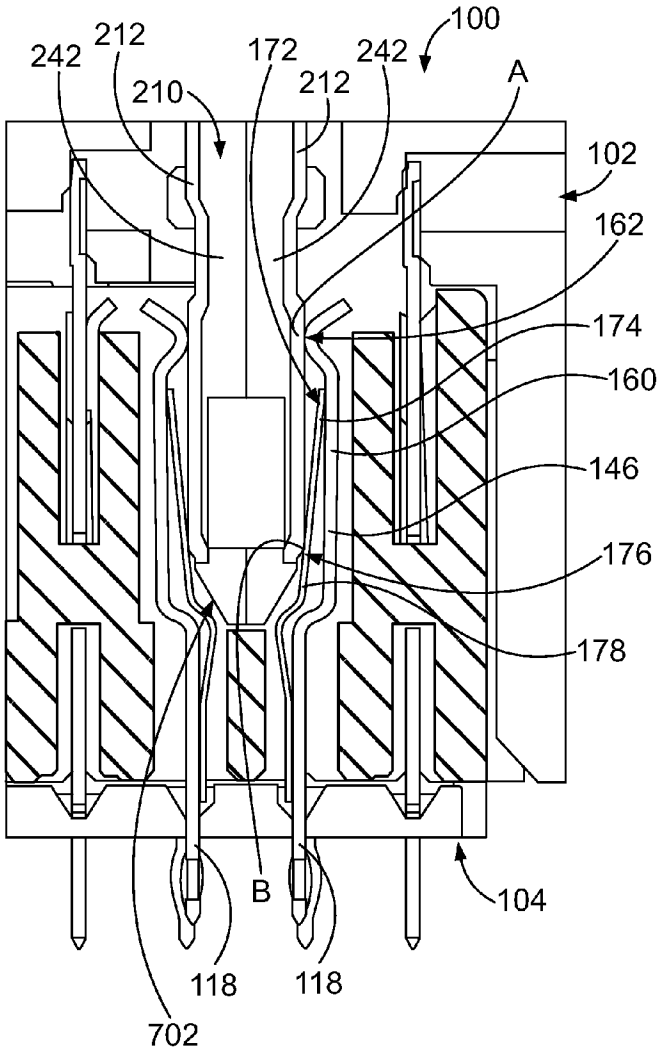
FIG. 7 is a cross-sectional view of the mezzanine connector assembly showing the mezzanine header connector mated with the mezzanine receptacle connector.

FIG. 7 is a cross-sectional view of the mezzanine connector assembly 100 showing the mezzanine header connector 102 mated with the mezzanine receptacle connector 104. The receptacle contacts 118 are shown in a pair mated with the corresponding pair of header contacts 212 of the contact assembly 210. When the mezzanine header connector 102 is mated with the mezzanine receptacle connector 104, the contact assembly 210 is received in the contact cavity 702. Dielectric holder(s) 242, which hold corresponding header contacts 212, are received in the contact cavities 702. The header contacts 212 are exposed along opposite sides of the dielectric holder(s) 242 for mating with the receptacle contacts 118.

When the contact assembly 210 is loaded in the contact cavity 702, the spring beams 160 are deflected outward away from each other. Each header contact 212 has at least two points of contact with the corresponding receptacle contact 118. For example, the mating interfaces 162, 176 of the receptacle contacts 118 engage the corresponding header contacts 212. The mating interface 162 of the main contact 146 engages one portion of the header contact 212 at an engagement point A while the mating interface 176 of the sub-contact 148 engages another portion of the header contact 212 at an engagement point B. When the header contact 212 engages the support beam 174, the sub-contact 148 is pressed outward toward the main contact 146. The support end 172 is pressed against the spring beam 160 to ensure electrical contact between the support beam 174 and the spring beam 160.

The sub-contact 148 reduces or eliminates an electrical stub as there is little or no portion of the header contact 212 that extends away from the mezzanine header connector 102 beyond the engagement point B. Additionally, the long spring beam 160 provides the receptacle contact 118 with a substantial amount of wipe along the header contact 212 during mating.

Figure 8:
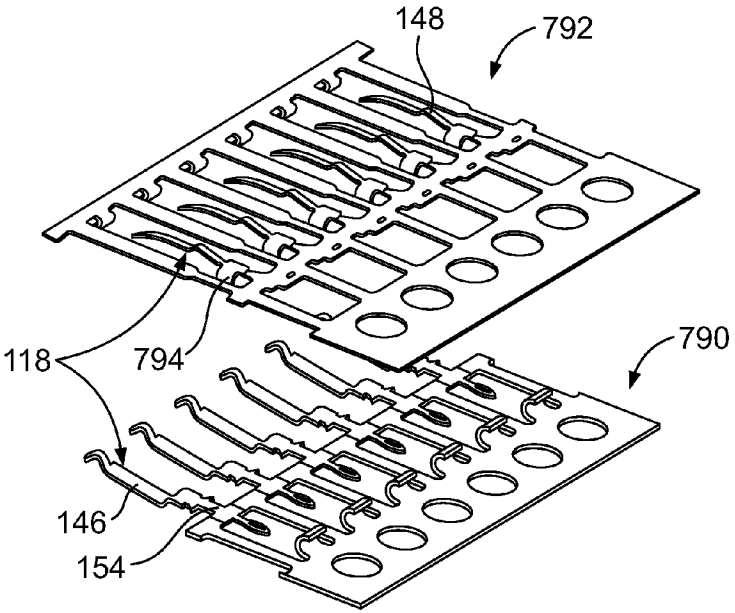
FIG. 8 illustrates carriers that are used to manufacture the receptacle contacts.

FIG. 8 illustrates carriers 790, 792 that are used to manufacture the receptacle contacts 118. The first carrier 790 includes a plurality of main contacts 146 stamped and formed into a desired shape. The second carrier 792 includes a plurality of sub-contacts 148 stamped and formed into a desired shape. During manufacture, the second carrier 792 is placed over the first carrier 790 with the main contacts 146 aligned with the sub-contacts 148.

In an exemplary embodiment, the sub-contacts 148 may include crimp arms 794 that are used to wrap around the bases 154 of the main contacts 146. The crimp arms 794 may be crimped to the corresponding base 154. Such crimp may be used to permanently fix the sub-contact 148 to the main contact 146 without the need for additional processes. In other embodiments, the crimping may temporarily position the sub-contact 148 relative to the main contact 146 and then another process, such as welding, is used to permanently fix the sub-contact 148 to the main contact 146. The carriers 790, 792 may be removed after the sub-contacts 148 are fixed to the main contacts 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A mezzanine receptacle connector comprising:

a housing having a mating end configured to be mated with a mezzanine header connector and a mounting end configured to be mounted to a circuit board, the mating end being opposite the mounting end, the mating end having a plurality of contact cavities configured to receive associated header contacts of the mezzanine header connector; and receptacle contacts received in corresponding contact cavities of the housing, each receptacle contact having a main contact and a sub-contact extending from the main contact, the sub-contact being independent and discrete from the main contact and being mechanically fixed thereto, and the sub-contact is engaging the main contact at two different points;

the main contact defining a first mating interface and the sub-contact defining a second mating interface, the first and second mating interfaces of each receptacle contact configured to directly engage the same header contact of the mezzanine header connector at different points of contact.

2. The mezzanine receptacle connector of claim 1, wherein the sub-contact includes a stamped and formed body and the main contact includes a stamped and formed body, the stamped and formed body of the sub-contact being stamped and formed independent from the stamped and formed body of the main contact such that the stamped and formed body of the sub-contact is configured to be mechanically fixed to the stamped and formed body of the main contact.

3. The mezzanine receptacle connector of claim 1, wherein the sub-contact is welded to the main contact.

4. The mezzanine receptacle connector of claim 1, wherein the sub-contact is crimped to the main contact.

5. The mezzanine receptacle connector of claim 1, wherein the sub-contact includes a base end and a support end, the base end being fixed to the main contact, the support end supporting the main contact, the base end and the support end defining the two different points of contact between the sub-contact and the main contact.

6. The mezzanine receptacle connector of claim 1, wherein the main contact comprises a base, a compliant pin extending from the base for termination to the circuit board, and a spring beam extending from the base for connection to the corresponding header contact, the spring beam defining the first mating interface.

7. The mezzanine receptacle connector of claim 6, wherein the spring beam is deflectable, the sub-contact being fixed to the base, the sub-contact engaging the spring beam and being deflectable with the spring beam.

8. The mezzanine receptacle connector of claim 6, wherein the spring beam extends to a distal end, the spring beam including a hook at the distal end, the hook being curved and defining the first mating interface, the sub-contact engaging the spring beam proximate to the hook.

9. The mezzanine receptacle connector of claim 1, wherein the receptacle contact extends along a contact axis, the main contact and the sub-contact being aligned with each other and with the header contact such that the sub-contact is positioned in line between the header contact and the main contact and with the first and second mating interfaces being offset along the contact axis.

10. The mezzanine receptacle connector of claim 1, wherein the main contact comprises a planar base and a spring beam extending from the base, the spring beam being bowed outward in a first direction from the base, the sub-contact being coupled to the base and being bowed outward in a second direction from the base, the sub-contact engaging the spring beam remote from the base.

11. A mezzanine receptacle connector comprising:

a housing having a mating end configured to be mated with a mezzanine header connector and a mounting end configured to be mounted to a circuit board, the mating end being opposite the mounting end; and a receptacle contact held by the housing, the receptacle contact having a main contact and a sub-contact extending from the main contact, the main contact having a base, the main contact extending between a mating end and a terminating end, the terminating end extending from the mounting end of the housing for termination to the circuit board, the mating end having a deflectable spring beam with a first mating interface configured to electrically couple to a corresponding header contact of the mezzanine header connector, the sub-contact extending from the base and having a supporting beam mechanically and electrically connected to the spring beam remote from the base, the sub-contact having a second mating interface configured to electrically couple to a corresponding header contact of the mezzanine header connector remote from the first mating interface.

12. The mezzanine receptacle connector of claim 11, wherein the sub-contact is discrete from the main contact and mechanically fixed thereto.

13. The mezzanine receptacle connector of claim 12, wherein the sub-contact is welded to the main contact.

14. The mezzanine receptacle connector of claim 12, wherein the sub-contact is crimped to the main contact.

15. The mezzanine receptacle connector of claim 11, wherein the sub-contact includes a base end and a support end, the base end being fixed to the main contact, the support end supporting the main contact, the base end and the support end defining two different points of contact between the sub-contact and the main contact.

16. The mezzanine receptacle connector of claim 11, wherein the sub-contact is fixed to the base, the sub-contact engaging the spring beam and being deflectable with the spring beam.

17. The mezzanine receptacle connector of claim 11, wherein the receptacle contact extends along a contact axis, the first and second mating interfaces being offset along the contact axis.

18. A mezzanine connector assembly comprising:

a mezzanine header connector having a plurality of contact assemblies, each contact assembly having at least one pair of header contacts arranged on opposite sides of a corresponding dielectric holder; and a mezzanine receptacle connector coupled to the mezzanine header connector, the mezzanine receptacle connector having a housing having a plurality of contact cavities, each contact cavity receiving an associated dielectric holder and pair of header contacts of the mezzanine header connector, the mezzanine receptacle connector having receptacle contacts arranged in pairs and received in corresponding contact cavities of the housing, each receptacle contact having a main contact and a sub-contact extending from the main contact, the sub-contact being independent and discrete from the main contact and being mechanically fixed thereto, the main contact having a first mating interface and the sub-contact having a second mating interface, the first and second mating interfaces of each receptacle contact directly engaging the same header contact of the mezzanine header connector at different points of contact.

19. The mezzanine receptacle connector of claim 18, wherein the sub-contact has at least two points of contact with the main contact.

20. The mezzanine receptacle connector of claim 18, wherein each receptacle contact extends along a contact axis, the contact axis being oriented vertically, the first and second mating interfaces engaging the corresponding header contact at different, vertically offset points of contact.

* * * * *